United States Patent [19]

Attridge et al.

[11] 4,186,369

[45] Jan. 29, 1980

[54] CONNECTOR FOR TERMINATING THE END OF A SHEATHED HEATING ELEMENT

[75] Inventors: John T. Attridge, Peru; John Barnstead, Kokomo, both of Ind.

[73] Assignee: Wylain, Inc., Dallas, Tex.

[21] Appl. No.: 847,917

[22] Filed: Nov. 2, 1977

[51] Int. Cl.[2] ..... H01C 1/02

[52] U.S. Cl. ..... 338/274; 219/541; 338/322

[58] Field of Search ..... 338/274, 276, 233, 322, 338/332; 219/541, 536, 335, 336; 174/77 R, 75 R; 29/610; 339/276 R

[56] References Cited

U.S. PATENT DOCUMENTS

| | | | |
|---|---|---|---|
| 990,234 | 4/1911 | Davis | 174/77 R |
| 2,617,009 | 11/1952 | Hasley | 219/541 X |
| 2,659,795 | 11/1953 | Boggs | 174/75 R |
| 2,807,696 | 9/1957 | Boggs et al. | 174/75 R |
| 2,876,322 | 3/1959 | Boggs | 338/274 X |
| 3,040,284 | 6/1962 | Connell | 339/61 |
| 3,113,284 | 12/1963 | Van Inthoudt | 338/274 |
| 3,197,617 | 7/1965 | Gillespie et al. | 219/541 |
| 3,354,294 | 11/1967 | Kollar et al. | 338/274 X |
| 3,512,123 | 5/1970 | Costello et al. | 339/276 T |
| 3,839,623 | 10/1974 | Portmann | 219/541 |

FOREIGN PATENT DOCUMENTS

| | | | |
|---|---|---|---|
| 494027 | 6/1953 | Canada | 338/274 |
| 496982 | 12/1938 | United Kingdom | 338/274 |

*Primary Examiner*—C. L. Albritton

*Attorney, Agent, or Firm*—Lane, Aitken & Ziems

[57] ABSTRACT

A connector for terminating the end of a sheathed heating element is formed by an elongated body having a cavity at one end. The cavity includes at least one surface having a diameter dimension adapted to slidingly engage one of the diameter surfaces of the heating element sheath, and a thrubore, concentrically located with respect to the cavity diameter, adapted to slidingly engage the terminal pin of the heating element. The connector will mate with a heating element if and only if the heating element terminal pin is properly located with respect to the heating element sheath.

12 Claims, 4 Drawing Figures

CONNECTOR FOR TERMINATING THE END OF A SHEATHED HEATING ELEMENT

BACKGROUND OF THE INVENTION

The present invention relates to connectors for terminating the end portion of sheathed heating elements and, more particularly, to a connector which serves to seal the end of the heating element and to mechanically and electrically connect an electric current carrying wire to the heating element.

Sheathed heating elements typically include a tubular sheath and a terminal pin which extends outwardly from the end of the sheath. The terminal pin is coaxially supported with respect to the sheath by a heat conductive, electrically insulative refractory-material. An electric current introduced to the terminal pin flows through a heating wire connected to the terminal pin to cause the wire to generate the desired heat.

For performance and safety reasons it is important that the terminal pin be electrically insulated from the sheath. This is accomplished during the manufacture of the heating element by coaxially locating the terminal pin with respect to the sheath to insure that a uniform thickness of the electrically insulative refractory-material surrounds the terminal pin. In this procedure, it is necessary to inspect the terminal pin-to-sheath dimension for each heating element to insure that there is at least a minimum acceptable thickness of insulating refractory-material separating the terminal pin and the sheath and that the insulative refractory material is of a uniform thickness. This inspection step contributes to the manufacturing costs of the heating element.

SUMMARY OF THE INVENTION

It is an object of the present invention to provide a connector for terminating the end of a sheathed heating element which will electrically insulate the terminal pin from the heating element, provide physical support for the terminal pin, and seal the end of the terminal pin.

It is another object of the present invention to provide a connector for terminating the end of a sheathed heating element which will eliminate the inspection of the terminal pin-to-sheath dimension and provide attendant savings in the cost of manufacturing heating elements.

It is another object of the present invention to provide a connector for terminating the end of a sheathed heating element which will eliminate the inspection of the terminal pin-to-sheath dimension without compromising the electrical safety of the assembled heating element.

It is a further object of the present invention to provide a connector for terminating the end of a sheathed heating element which will assemble to a heating element if and only if the terminal pin is properly located with respect to the sheath.

Toward the fulfillment of these and other objects, the present invention provides a connector for terminating the end of a sheathed heating element wherein the heating element includes a sheath having an outside dimension and an inside dimension, and a terminal pin which extends outwardly of the heating element. The connector includes a body portion having a cavity formed at one end, and a thrubore which opens into the cavity and is coaxial therewith. The cavity surface is adapted to slidingly engage a corresponding surface portion of the sheath, and the thrubore is adapted to slidingly engage the terminal pin.

BRIEF DESCRIPTION OF THE DRAWINGS

The above brief description, as well as further objects, features, and advantages, of the present invention will be more fully appreciated by the reference to the following detailed description of a presently preferred but nonetheless illustrative embodiment in accordance with the present invention, when taken in connection with the accompanying drawings wherein.

DESCRIPTION OF THE PREFERRED EMBODIMENT

Figure 1:
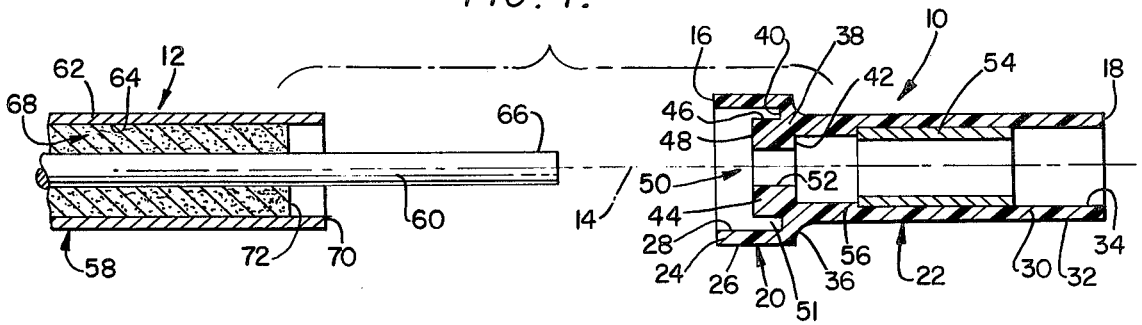
FIG. 1 is a cross-sectional view of the connector of the present invention shown in an axially spaced relation to an exemplary heating element.

As shown in FIG. 1, the reference character 10 refers in general to the connector of the present invention which is formed by an elongated cylindrical body symmetrically disposed about a longitudinal axis 14. The connector 10 includes a first end 16 and a second end 18 and, in the preferred embodiment, is formed as a unitary structure from a rigid thermoplastic material such as nylon. The connector 10 is divided along its longitudinal axis 14 into a first hollow cylinder, designated herein as a sheath flange 20, and a second hollow cylinder, designated herein as a crimp sleeve 22. The sheath flange 20 includes a wall 24 having an outside surface 26 formed at a selected outside diameter dimension and an inside surface 28 formed at a selected inside diameter dimension. In a like manner, the crimp sleeve 22 includes a wall 30 having an outside surface 32 formed at a selected inside diameter and an inside surface 34 formed at a selected inside diameter. An exterior fillet 36 provides a transition between the outside surface 26 of the sheath flange 20 and the outside surface 32 of the crimp sleeve 22.

A partition 38 is formed in a plane transverse to the longitudinal axis 14 and separates the interior of the sheath flange 20 from the interior of the crimp sleeve 22. The partition 38 includes a wall 40 facing the interior of the sheath flange 20 and another wall 42 facing the interior of the crimp sleeve 22. A boss or pilot, designated herein as a pin insulator 44, is formed on and extends axially of the wall 40. The pin insulator 44 includes an outer surface 46 having a diameter dimension and an axial face 48. The inside surface 28 of the sheath flange 20 and the wall 40 define a cavity, or counter bore, 50. Also, the inside surface 28 of the sheath flange 20, the outer surface 46 of the pin insulator 44, and the wall 40 define a cylindrical or tubular groove 51. The cavity 50 and the tubular groove 51 are both adapted to receive the end portion of a sheathed heating element 12 as described below.

The pin insulator 44 has a hole or thrubore 52 formed therein which extends from the axial face 48 through the pin insulator 44 and the partition 38 to the wall 42. The thrubore 52 is formed concentric and coaxial with the inside surface 28 of the sheath flange 20 and the outside diameter surface 46 of the pin insulator 44. In the preferred embodiment, the inside surface 28 of the sheath flange 20, the thrubore 52, and the outside diameter surface 46 of the pin insulator 44 are concentric with one another and also coaxial with the longitudinal axis 14 of the connector 10.

An electrically conductive ferrule or barrel 54, preferably formed from tin plated copper, is located on the inside surface 34 of the crimp sleeve 22 and assists in mating the connector 10 to the heating element 12 as described below. A step 56 or shoulder is formed in the inside surface 34 of the crimp sleeve 22 to locate the barrel 54 in an axially spaced relation from the wall 42 and the end 18.

The heating element 12, to which the connector 10 is adapted to be assembled to and mated with, includes a sheath 58 and a terminal pin 60, also known in the art as a cold pin. The sheath 58 has a tubular cross-section and has an outside surface 62 formed at a selected outside diameter and an inside surface 64 formed at a selected inside diameter. The terminal pin 60, which includes a distal portion 66, extends axially outward of the sheath 58 and is supported in a coaxial relation with the sheath 58 by a refractory material 68 deposited in the annular space between the terminal pin 60 and the sheath 58. The refractory material 68 is not extended to the end of the sheath 58 but is terminated at an end wall 72 near the sheath end 70. A tubular guide 74 is thus defined near the end 70 of the heating element 12 and includes that portion of the sheath 58 between the plane of the end wall 72 of the refractory material 68 and the end 70 of the heating element 12.

The end of the terminal pin 60 remote from the distal end 66 is connected to an electrical heating wire (not shown). Typically, the heating wire is a nickel-cromium alloy wire formed as an elongated helix. Heat is generated when an electric current is passed through the heating wire. The refractory material 68 serves as a heat conductive medium to conduct the heat from the heating wire to the sheath 58 and as an electrical insulator to insulate the sheath 58 from the electric current flowing through the terminal pin 60 and the heating wire.

Figure 2:
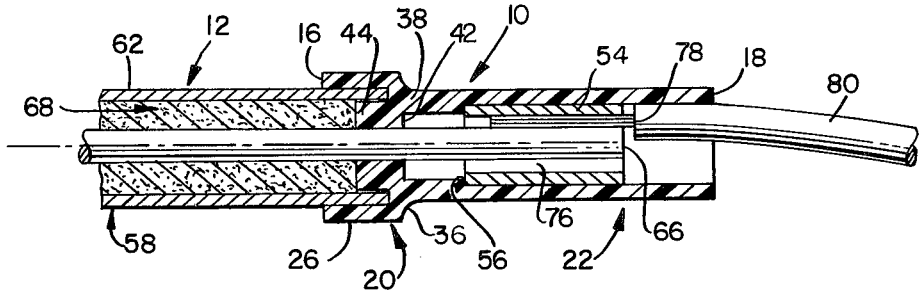
FIG. 2 is a view similar to FIG. 1, but showing the connector assembled to the heating element.

The connector 10 and the heating element 12 are assembled as shown in FIG. 2. In the assembly step, the terminal pin 60 is inserted into the thrubore 52 and the connector 10 is caused to slide along the terminal pin 60 until the end portion of the heating element 12 is received by the cavity 50 and the tubular guide 74 is received by the tubular groove 51. The inside surface 28 of the sheath flange 20 slides over the outside surface 62 of the sheath 58, the exposed inside surface 64 of the sheath 58 slides over the outside diameter surface 46 of the pin insulator 44 and the end 70 of the sheath 58 abuts the wall 40. As a result the distal portion 66 of the terminal pin 60 extends into the interior of the crimp sleeve 22 to define an annular space 76 between the terminal pin 60 and the barrel 54.

In order to seal the refractory material 68 against contamination by moisture or other impurities, a sealing means (not shown) may be placed between the end wall 72 of the refractory material 68 and the axial face 48 of the pin insulator 44. The sealing means may take one of several forms including a discrete, resilient elastomer-washer or a deposit of a viscous sealing material or mastic such as silicone rubber.

Figure 3:
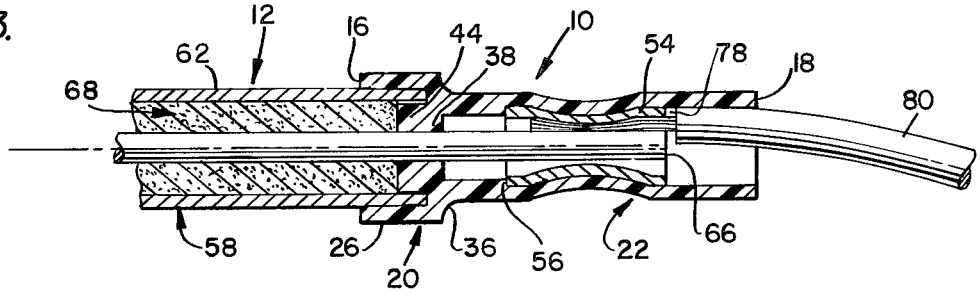
FIG. 3 is a view similar to FIG. 2, but showing a conductor portion of an electrical wire crimped to a terminal pin portion of the heating element.

After the connector 10 has been mated to the heating element 12 as shown in FIGS. 2 and 3, the conductor portion 78 of an insulated electric wire 80 is inserted into the second end 18 of the connector 10 and into the annular space 76 defined between the barrel 54 and the distal end 66 of the terminal pin 60. The barrel 54 is then mechanically deformed in a radially inward direction to crimp the conductor 78 to the terminal pin 60. As a result, the conductor 78 and the connector 10 are both mechanically secured to the terminal pin 60 and the conductor 78 is electrically connected to the terminal pin 60.

The connector 10 is so dimensioned that a clearance or sliding fit exists between the outside surface 62 of the sheath 58 and the inside surface 28 of the sheath flange 20, the outside diameter surface 46 of the pin insulator 44 and the inside surface 64 of the sheath 58, and the outside diameter of the terminal pin 60 and the diameter surface of the thrubore 52. A clearance or sliding fit is one in which the applicable maximum and minimum dimensions of the mating diameters are so prescribed that a clearance always results when the mating parts are assembled. As can be readily appreciated, the fit between the various diameters of the connector 10 and the heating element 12 can be made to vary from a close sliding fit in which the connector 10 and the heating element 12 are assembled without any perceptible radial play between the parts to a looser fit. By making the sheath flange 20 inside surface 28, the pin insulator 44 outside diameter surface 46 and the thrubore 52 coaxial with one another and so dimensioning the connector 10 for the sliding or clearance fits described above, the connector 10 will receive the end of the heating element 12 if and only if the terminal pin 60 is located at its desired or concentric radial dimension with respect to the sheath 58.

Figure 4:
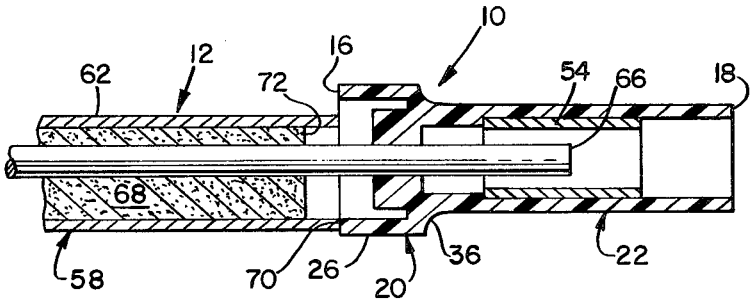
FIG. 4 is a cross-section view of the connector of FIGS. 1–3 and a heating element in which the terminal pin of the heating element is eccentrically located with respect to the heating element sheath.

In the case where the heating element 12 has been manufactured with the terminal pin 60 eccentrically located with respect to the sheath 58, the connector 10 of the present invention will not receive the end of the heating element 12 since the end 16 of the sheath flange 20 will interfere with and contact the end 70 of the heating element 12. FIG. 4 illustrates a connector 10 incorporating the present invention and a heating element 12 in which the terminal pin 60 has been eccentrically located with respect to the sheath 58. The eccentricity or off-center location of the terminal pin 60 has been exaggerated to clearly demonstrate the desirable feature of the connector 10. As shown, the distal end 66 of the terminal pin 60 has been inserted into the thrubore 52 of the connector 10 and the connector 10 moved toward the end 70 of the heating element 12 in an attempt to cause the sheath flange 20 to receive the end portion of the heating element 12. Since the terminal pin 60 is off-center, that is, eccentrically located with respect to the sheath 58 and the connector 10 is positionally located on the terminal pin 60, the end 16 of the sheath flange 20 will contact and interfere with a portion (not shown) of the end 70 of the sheath flange 20, thereby preventing assembly of the heating element 12 to the connector 10.

As is readily apparent, the connector 10 of the present invention permits a termination of the heating element 12 which electrically insulates the terminal pin 60 from the sheath 58, provides physical support for the terminal pin 60, seals the end of the heating element 12, and permits one to eliminate the terminal pin 60 spacing inspection prior to the assembly of the connector 10 to the heating element 12 without a compromise in the electrical safety of the heating element 12.

As is apparent to those skilled in the art, various changes and modifications may be made to the connector without departing from the spirit and scope of the present invention as recited in the appended claims and their legal equivalent.

What is claimed is:

1. A connector for terminating the end of a heating element, wherein said heating element includes a sheath and a terminal pin extending outwardly from the end of said sheath, comprising:

a connector body having a surface portion defining a cavity at an end thereof and a thrubore opening into said cavity and coaxial therewith;

said thrubore adapted to fit over said terminal pin in sliding relation thereto;

said surface portion adapted to slidingly engage a corresponding surface portion of said sheath;

a crimp sleeve located at the other end of said connector body;

an electrically conductive barrel located in said crimp sleeve; and said thrubore opening into said crimp sleeve.

2. The connector claimed in claim 1, wherein said heating element sheath has an outside diameter surface and an inside diameter surface;

said cavity has a first surface having a diameter dimension adapted to slidingly engage said outside diameter of said sheath and a second surface having a diameter dimension adapted to slidingly engage said inside diameter of said sheath.

3. The connector claimed in claim 1, further comprising:

means for axially spacing said barrel a predetermined distance from said other end.

4. The connector claimed in claim 1, wherein said connector is formed as a unitary structure from a rigid thermoplastic material.

5. A connector for terminating the end of a heating element wherein said heating element includes a sheath having a tubular guide portion at an end thereof, and a terminal pin extending outward from said end, comprising:

a connector body having a surface defining a cavity at one end thereof;

means formed as a unitary structure with said body and cooperating with said surface to define a tubular groove therebetween for receiving said tubular guide portion in sliding relation thereto;

said means having a thrubore formed therein in coaxial relation to the tubular groove and adapted to slidingly engage said terminal pin;

a crimp sleeve located at the other end of said connector body;

an electrically conductive barrel located in said crimp sleeve; and said thrubore opening into said crimp sleeve.

6. The connector claimed in claim 5, wherein said cavity includes a surface having an inside diameter dimension adapted to slidingly engage an outside diameter surface of said tubular guide portion;

said means includes a surface having an outside diameter dimension adapted to slidingly engage an inside diameter surface of said tubular guide portion.

7. The connector claimed in claim 5, wherein said tubular groove further comprises:

a bottom wall adapted to be engaged by said end of said tubular guide portion and axially locate said connector body with respect to said heating element.

8. The connector claimed in claim 5, wherein said connector body is symmetrically formed about a longitudinal axis.

9. The connector claimed in claim 8, wherein said cavity is formed coaxial with said longitudinal axis.

10. The connector claimed in claim 9, wherein said thrubore is formed coaxial with said longitudinal axis.

11. The connector claimed in claim 5, further comprising:

means for axially spacing said barrel a predetermined distance from said other end.

12. The connector claimed in claim 5, wherein said connector is formed as a unitary structure from a rigid thermoplastic material.

* * * * *